US005112044A

United States Patent [19]

Dubats

[11] Patent Number: 5,112,044

[45] Date of Patent: May 12, 1992

[54] PERAMBULATING THERAPEUTIC SUPPORT

[76] Inventor: Barbara A. Dubats, 117 Neptune La., Apt. E, Holmes Beach, Fla. 34217

[21] Appl. No.: 600,860

[22] Filed: Oct. 22, 1990

[51] Int. Cl.[5] ..... A45B 1/02

[52] U.S. Cl. ..... 482/68; 135/85; 188/1.12; 188/29; 297/5

[58] Field of Search ..... 135/85, 67; 297/5, 6; 272/20, 70.4, 70.3

[56] References Cited

U.S. PATENT DOCUMENTS

| | | | |
|---|---|---|---|
| 2,437,778 | 3/1948 | Ames | 297/6 |
| 2,885,720 | 5/1959 | Seeberger | 16/44 |
| 3,237,940 | 3/1966 | Johnson | 188/29 |
| 4,094,330 | 6/1978 | Jong | 135/67 |
| 4,251,105 | 2/1981 | Barker | 135/67 |
| 4,518,002 | 5/1985 | Battiston | 135/67 |
| 4,621,804 | 11/1986 | Mueller | 135/67 |
| 4,941,497 | 7/1990 | Prather | 135/67 |

FOREIGN PATENT DOCUMENTS

| | | | |
|---|---|---|---|
| 2274274 | 2/1976 | France | 135/67 |
| 434161 | 8/1935 | United Kingdom | 16/44 |
| 1342397 | 1/1974 | United Kingdom | 135/67 |

*Primary Examiner*—Henry E. Raduazo

*Attorney, Agent, or Firm*—Joseph C. Mason, Jr.; Ronald E. Smith

[57] ABSTRACT

A prosthetic-type device which that restores independent ambulatory ability to individuals who have experienced diminished mobility includes a "U"-shaped member that supports a flexible harness, similar to that employed by mountain climbers. This harness encloses the waist, with additional support for the occupant provided by a crotch strap, and maintains body position of the occupant at an appropriate height, adjustable via a button-operated pin locking system incorporated into a rear vertical support member, allowing the occupant's legs to reach the floor. The U-shaped support member is curved, and attaches to a height adjustment housing via the pin locking system, and subsequently into a base, on which are fixed a plurality of swivel mounted casters, each with a weight-activated braking mechanism.

15 Claims, 7 Drawing Sheets

PERAMBULATING THERAPEUTIC SUPPORT

BACKGROUND OF THE INVENTION

1. Field of the Invention

This invention relates to mechanical prosthetic and therapeutic aids employed by disabled persons to restore independent mobility.

2. Description of Prior Art

In the course of institutionalization of the aged, infirm, or otherwise disabled, and in the process of recuperation from debilitating injuries and diseases, several types of ambulatory aides are in common use. For those who have lost all or most of their ambulating powers, wheel chairs provide total support, allowing mobility over smooth surfaces, propelled by hand motion for independent mobility. Walkers, consisting of a three sided frame, and four legs, usually tipped with rubber caps are also in widespread use. The individual lifts the frame, extends it forward with his arms, and, thus braced to maintain balance, walks for several steps. A version of this device has wheels on the front two legs, which allow the individual to push the device forward; otherwise, the ambulating process is the same. Here, upper body strength is required to lift the rear wheels of the walker, and push it forward—almost as much as lifting the entire frame. Patients commonly scoot the frame along the floor causing disturbing noises by friction between the rubber tips and the surface, and providing little benefits beyond standard walkers. Last are canes, which partially supplement the weakened leg during walking.

It has been recognized that a void exists between the wheel chair, which requires absolutely no ambulating powers, and the walker, which requires the ability to stand, balance, and totally support the weight of the body.

Several approaches are disclosed in patents. Discussed here are: Mueller, U.S. Pat. No. 4,621,804, Nov. 11, 1986; Stillings, U.S. Pat. No. 4,342,465, Aug. 3, 1982; Morris, et. al., U.S. Pat. No. 4,643,211, Feb. 17, 1987; Goldberg et. al., U.S. Pat. No. 3,488,088, Jan. 6, 1970; and Androw et. al., U.S. Pat. No. 3,778,052, Dec. 11, 1973.

Mueller, U.S. Pat. No. 4,621,804, Nov. 11, 1986, envisioned a single, flexible panel supported by horizontal bars front and rear. The illustrated embodiment of this device has four legs, each with swivel casters. This device has provisions for total support of the occupant, and removable, or retractable wheels for patients capable of limited self support. Obviously, the degree of disability requiring total support with this devise, i.e. suspended by a single crotch strap made of flexible material, puts the occupant at an severe disadvantage when attempting to propel him or herself.

For the extremely incapacitated, the entire weight is supported underneath the crotch, placing the occupant, particularly heavier patients, in painful, uncomfortable and potentially injurious position. In the less dramatic cases of disability, and in the initial stages of recovery from injuries, a stumble would result in the occupant falling either forward, or to one side, the center of gravity being above the support point. The device, in such a case, would continue to travel on its free wheeling casters, risking complete loss of vertical stability, seriously injuring the occupant with damage to the head, as well as the genitals.

With the casters removed, or retracted as described, the device is no more than a conventional walker, of the type in common use throughout the world, the design and utility of which is in the public domain.

In another approach, re Stillings, U.S. Pat. No. 4,342,465, Aug. 3, 1982, the rolling walker resembles the ones used by toddlers learning their first steps. The device envisioned in this patent has a framework which is in two sections hinged together at one side. The sections can be opened to permit entry of the handicapped person, whereupon the sections are rigidly locked together. A vertically adjustable seat is supported within the framework adjacent the rear portion, and the legs terminate in casters to permit the walker to roll along a smooth surface. Once the person is located in the device, a flexible, cushioned support cord is extended from the front of the seat, and attached to the forward, hinged portion of the frame. The support cord functions partially as a saddle, and partially as a support, should the patient stumble or fall. Said support cord, being essentially a single strap under the crotch, poses the same difficulties observed in Mueller. The seat, too, will interfere with normal walking motions, and inhibit the disabled from using it. Nor will the seat protect from injury, should the patient lose his or her balance, and fall backwards.

In Morris, et. al., U.S. Pat. No. 4,643,211, Feb. 17, 1987, a standard walker is equipped with casters on the forward legs, and a fold down seat. Here, the seat is intended to be used during rests between periods of ambulating, and not for support.

Goldberg et. al., U.S. Pat. No. 3,488,088, Jan. 6, 1970, describes a wheeled vehicle with a frame on three sides, and a bicycle-type seat mount attached to the upper and lower horizontal members of the frame via rigid bars. The seat itself is mounted on a vertical bar, and terminates with another swivel caster. The devise is presented as a therapeutic aid to obviate flexion contractures of selected body joints during convalescence. For feeble patients susceptible to falls, the horizontal members extending forward from the seat support bar present significant danger of injury to the crotch area. Nor is the height of the frame adjustable. Thus, this device is a form of scooter, and suitable strictly in those situations the inventor envisioned.

Most similar of all in concept and execution, is Androw et. al., U.S. Pat. No. 3,778,052, Dec. 11, 1973. Here, a complex harness arrangement is attached to the uppermost members of an open framework, which extends above the head of the occupant. As is common in all devises, the framework encloses three sides of the patient, and terminates in swivel casters. Here, however, the harness supports the waist, as well as the crotch, of the occupant, who is additionally aided by adjustable crutch heads, for positioning beneath the armpits of the patient. This structure is large and cumbersome, conceivably over seven feet in height, to accommodate taller people. The harness may become unstable, allowing the occupant to swing, and, if he or she releases the crutch heads, could fall into a completely upended position. The entire device could easily tip over. In this vision, the harness assembly involves a large number of straps, hooks, and buckles, causing it to be expensive to manufacture, and difficult to put on.

None of the prior art devices adequately fit the niche between the walker and the wheel chair.

SUMMARY OF THE INVENTION

A prosthetic-type device which restores independent ambulatory ability to individuals who have experienced diminished mobility due to certain types of disabilities, various debilitating diseases, or the general weaknesses of advancing age, and to individuals attempting to regain such ability in the course of therapy. This device provides a versatility, safety, and simplicity of operation previously unknown to the art. Thus the perambulating therapeutic support provides a device to fill the void between traditional wheel chairs, which require no ambulating abilities, but provide only upper body exercise, and traditional walkers, which require strength and stamina many persons in such situations do not possess.

A U-shaped member supports a flexible harness, similar to that employed by mountain climbers. This harness encloses the waist, with additional support for the occupant by means of a crotch strap, and maintains body position of the occupant at an appropriate height, adjustable via a button-operated pin locking system incorporated into the rear vertical support member, allowing the occupant's legs to reach the floor. The U-shaped support member is curved, and attaches to the height adjustment housing via said pin locking system, and subsequently into a base, on which are fixed a plurality of swivel mounted casters, each with weight activated braking mechanisms.

The occupant grasps the padded side bars and of the supporting U-shaped member, slightly elevating the entire device, thus unlocking said braking mechanisms and releasing the casters, performs the appropriate ambulating movements, and propelling himself or herself, along with the device, in the desired direction. Said weight pressure breaking mechanisms will halt any unintentional horizontal motion, should the occupant stumble, trip, or otherwise loose the power to support himself or herself, allowing safe usage of the device where constant supervision is not available. In addition, those for whom stamina for sustained locomotion is diminished, the safety support provides the means to pause and rest, without danger of falling.

The braking pad is retractable on the casters, allowing the occupant to vary the amount of downward pressure required to engage them, or, if desired, totally disengage the brake pads.

The Perambulating Therapeutic Support, in the embodiment expressed in this disclosure provides these advantages:

(a) Dual vertical supports via a rear housing simplifies adjustment.

(b) A harness with dual front and rear straps supports at or above the center of gravity.

(c) A harness of simple configuration facilitates use.

(d) Weight actuated brakes halt horizontal motion if loss of control should occur.

(e) The device has width adjustments to accommodate any size patient.

(f) The device has provisions to suspend an intravenous feeding bag.

(g) Detachable wide support stays lower the chances of the device tipping sideways, should an unsteady occupant stumble, and rock the frame.

(h) The patient can back the device into a toilet stall, disengage him or herself from the harness and use this facility without assistance.

Further objects and advantages of this invention are to provide an easily employed, safe method for the aged and disabled to use whatever degrees of ambulatory abilities they possess to restore self-confidence, gain the benefits of exercise, and, possibly regain the ability to ambulate without assistance. Other objects and advantages of this invention will become apparent from the ensuing descriptions and drawings.

BRIEF DESCRIPTION OF THE DRAWINGS

In the drawings, mirror image parts have different numbers, and names distinguished by the qualifiers, "left" and "right". Assemblies pictured in detail in subsequent drawings are also numbered.

DETAILED DESCRIPTION OF THE PREFERRED EMBODIMENT

Reference should now be made to the drawings, in which the same reference numbers are used throughout the different figures to designate the same components. Initially, reference should be made to FIG. 1, which illustrates the perambulating therapeutic support in a preferred embodiment of the invention, as used by a partially disabled or convalescing patient. A lower width adjustment assembly 37 locks the telescoping "U"-shaped base assembly 87 (see FIG. 7A), which is composed of right and left lower support members, 19 and 25 respectively, forming a three-sided lower frame partially surrounding the occupant.

Figure 3:
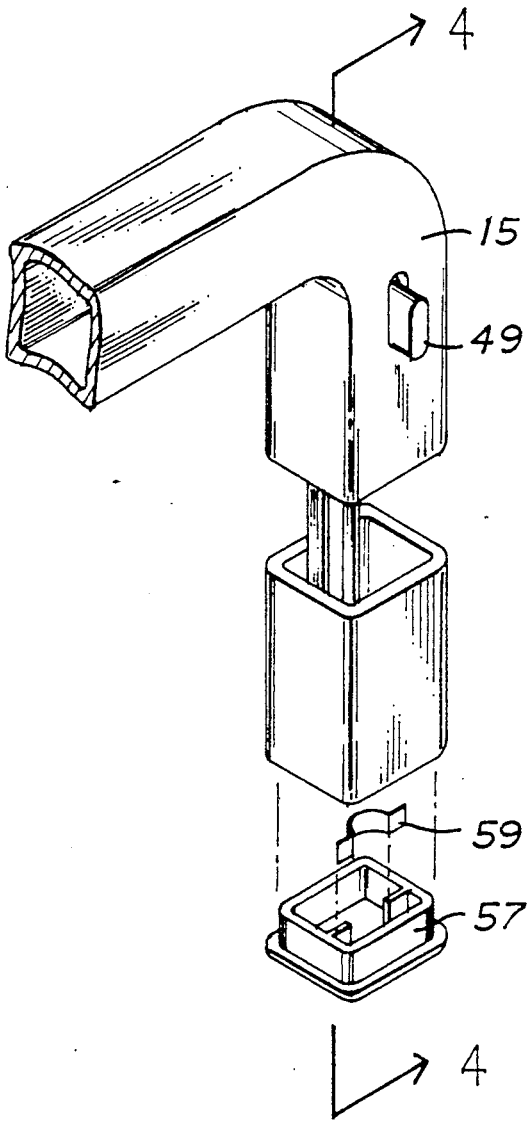
FIG. 3 is an exploded perspective view of the height adjustment assembly.
Figure 4:
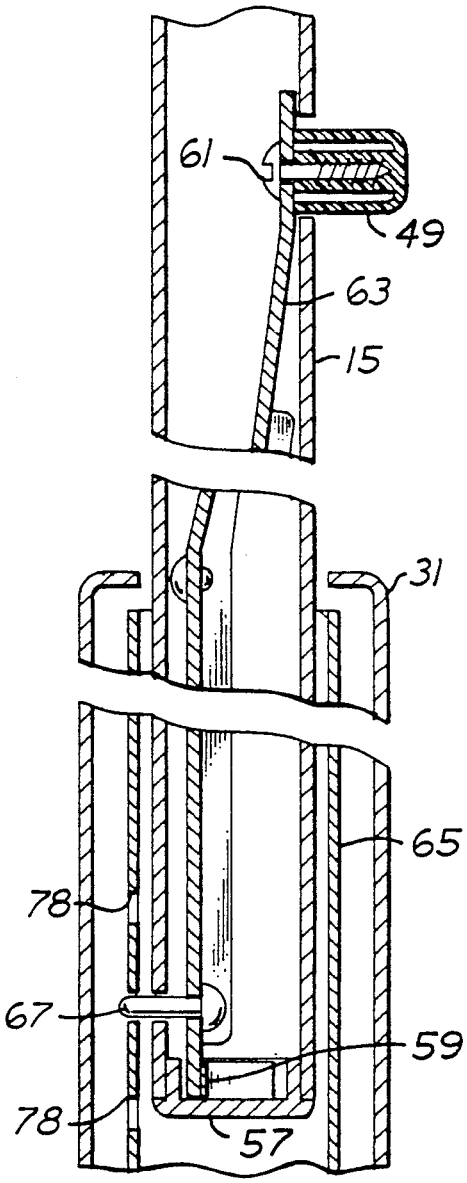
FIG. 4 is a sectional view of the height adjustment mechanism.
Figure 7:
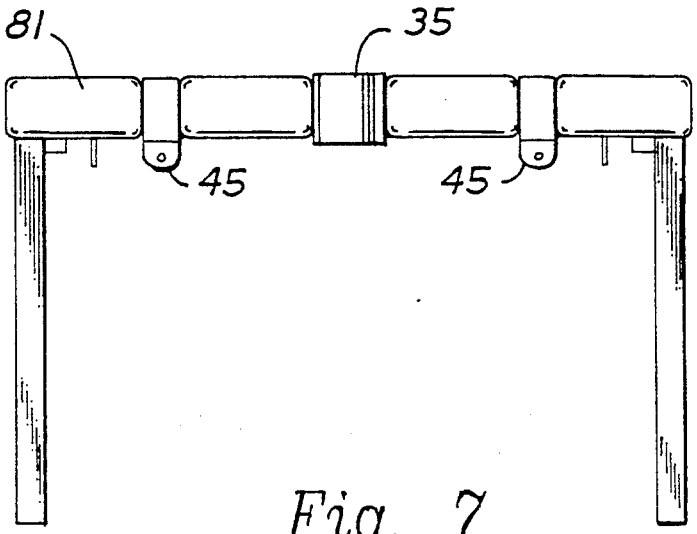
FIG. 7 is a top plan view of the upper support assembly.

A "U"-shaped upper support assembly 81 (see FIGS. 1 and 7) joins to right and left lower support assemblies 83 and 85 through apertures in height adjustment housings 31 and 33. The vertical extensions of upper support members 15 and 21 are housed within a height adjustment assembly, FIGS. 3 and 4. Movement of a height adjustment push button 49, connected to a lock linkage pivot lever 63 via screw 61, causes a height adjustment locking pin 67 fastened to the opposite end, and protruding through vertically spaced apertures formed in the vertical extensions of each of the upper support members, to disengage from holes 78 (see FIGS. 2 and 4) evenly spaced in the inside support shroud 65. A spring 59 mounted in an end cap 57 returns the height adjustment locking pin 67 to the proper hole in the inside support shroud 65 when the proper height is attained.

Figure 1:
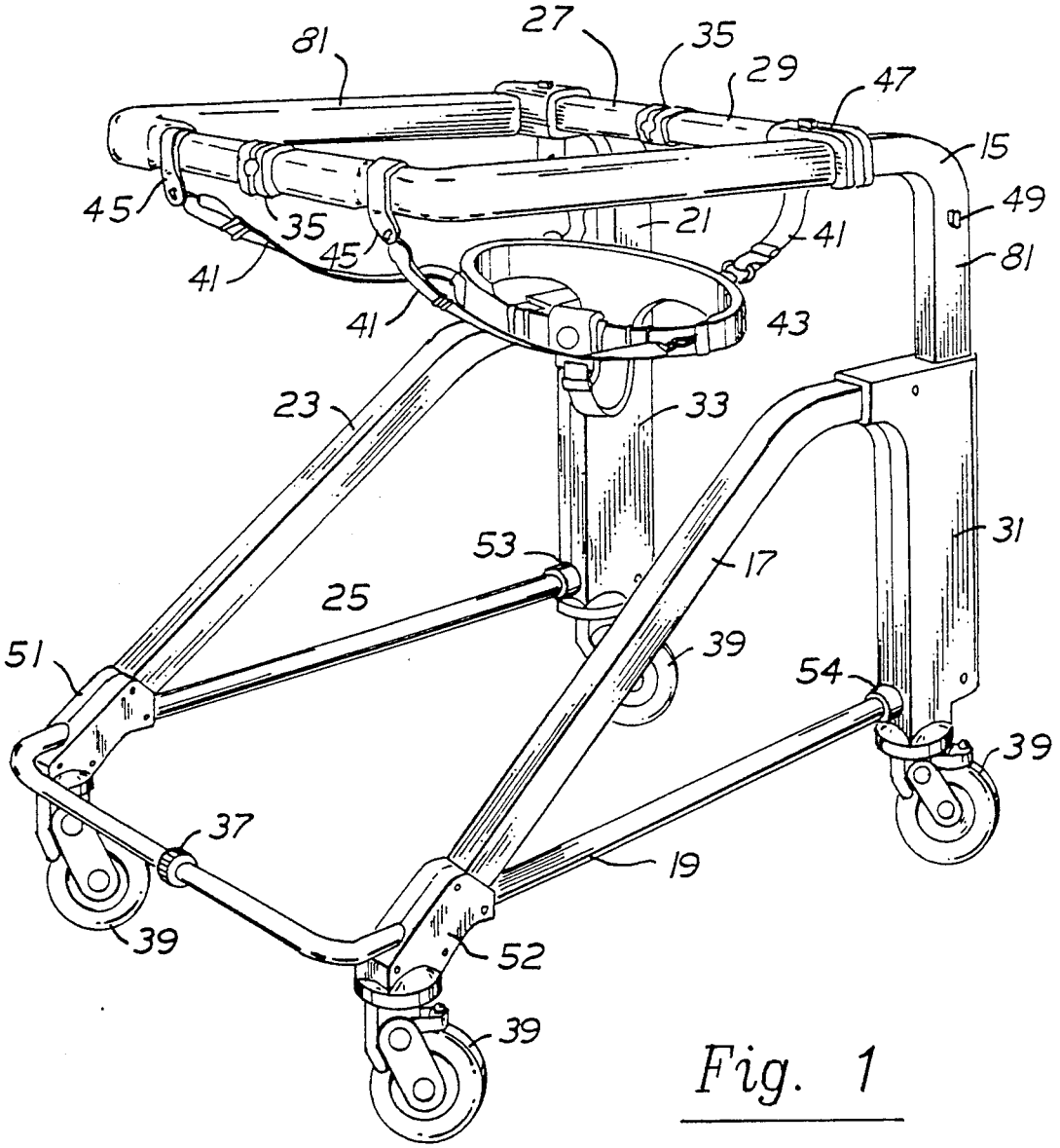
FIG. 1 shows a perspective view of the preferred embodiment of the invention.

Telescoping "U"-shaped upper support assembly 81 locks via a width adjustment assembly, 35 in FIG. 1, and forms a three-sided upper frame partially surrounding the occupant. To close the rear opening, telescoping left and right rear stay bars, 27 and 29 respectively, extend between the right and left upper support members, 15 and 21 respectively, via a pair of locking rear bar support brackets, both numbered 47. Together, the left and right rear stay bars, 27 and 29 respectively, and the left and right upper support members, 21 and 15, respectively, form the support for a harness assembly 43.

The harness assembly 43 consists of adjustable harness support straps 41 which connect front and rear by harness support brackets 45.

Figure 5:
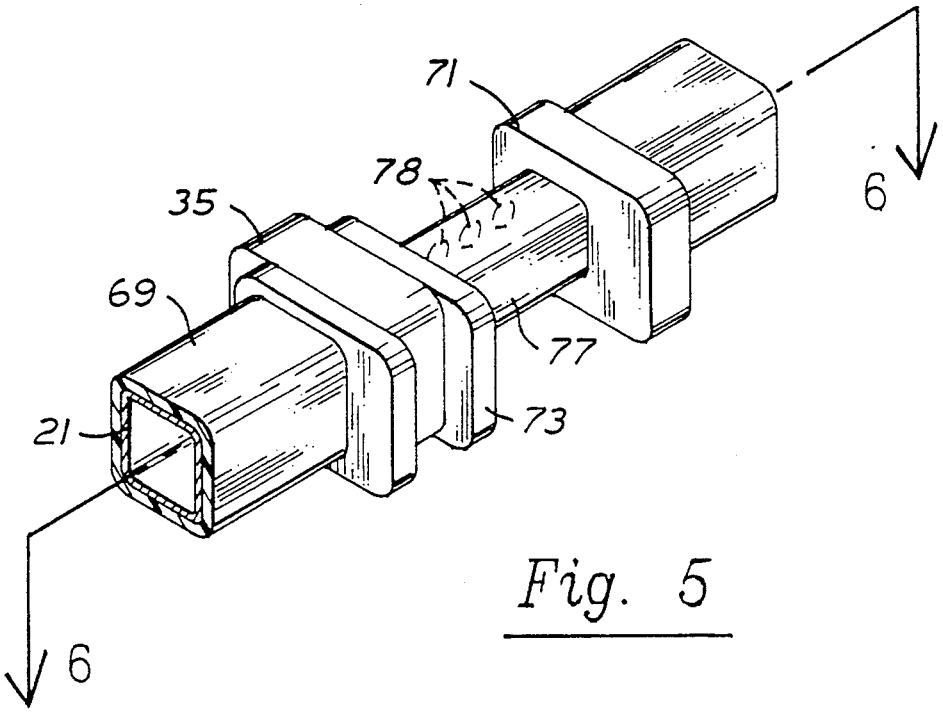
FIG. 5 is a perspective view of a width adjustment assembly.
Figure 6:
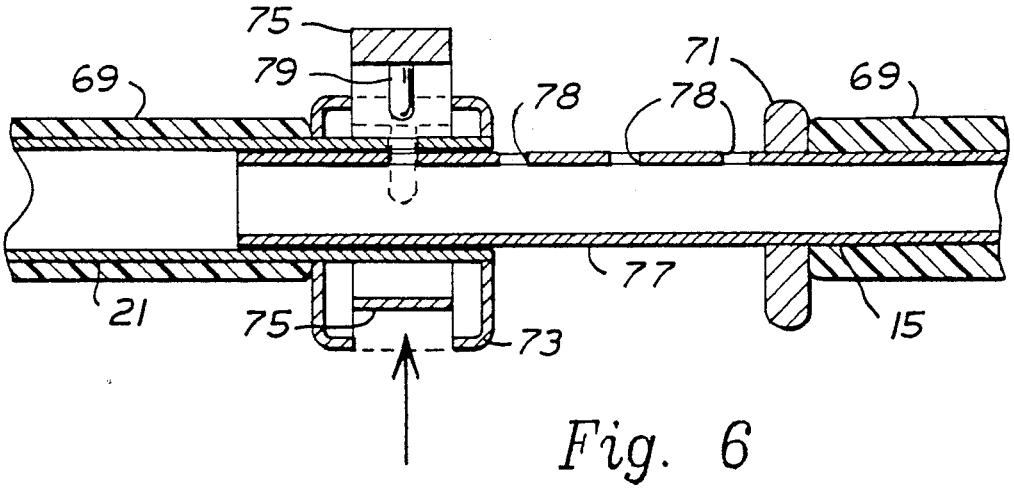
FIG. 6 is a sectional view taken along line 6—6 in FIG. 5.

FIGS. 5 and 6 show one of the upper width adjustment assemblies, (both numbered 35 in FIG. 1) by means of which the width of the entire frame can be changed. An inside telescoping tube 77, with holes 78 evenly spaced in it, is attached to the right upper support member 15, and moves inside the left upper support member 21. A width adjustment release pin 79 disengages these holes 78 when a release button 75, mounted inside a release button guide 73, is pressed, as indicated by the directional arrow in FIG. 6. Padded grips 69 cushion the metal tubing of the right and left upper support members 15 and 21.

Figure 2:
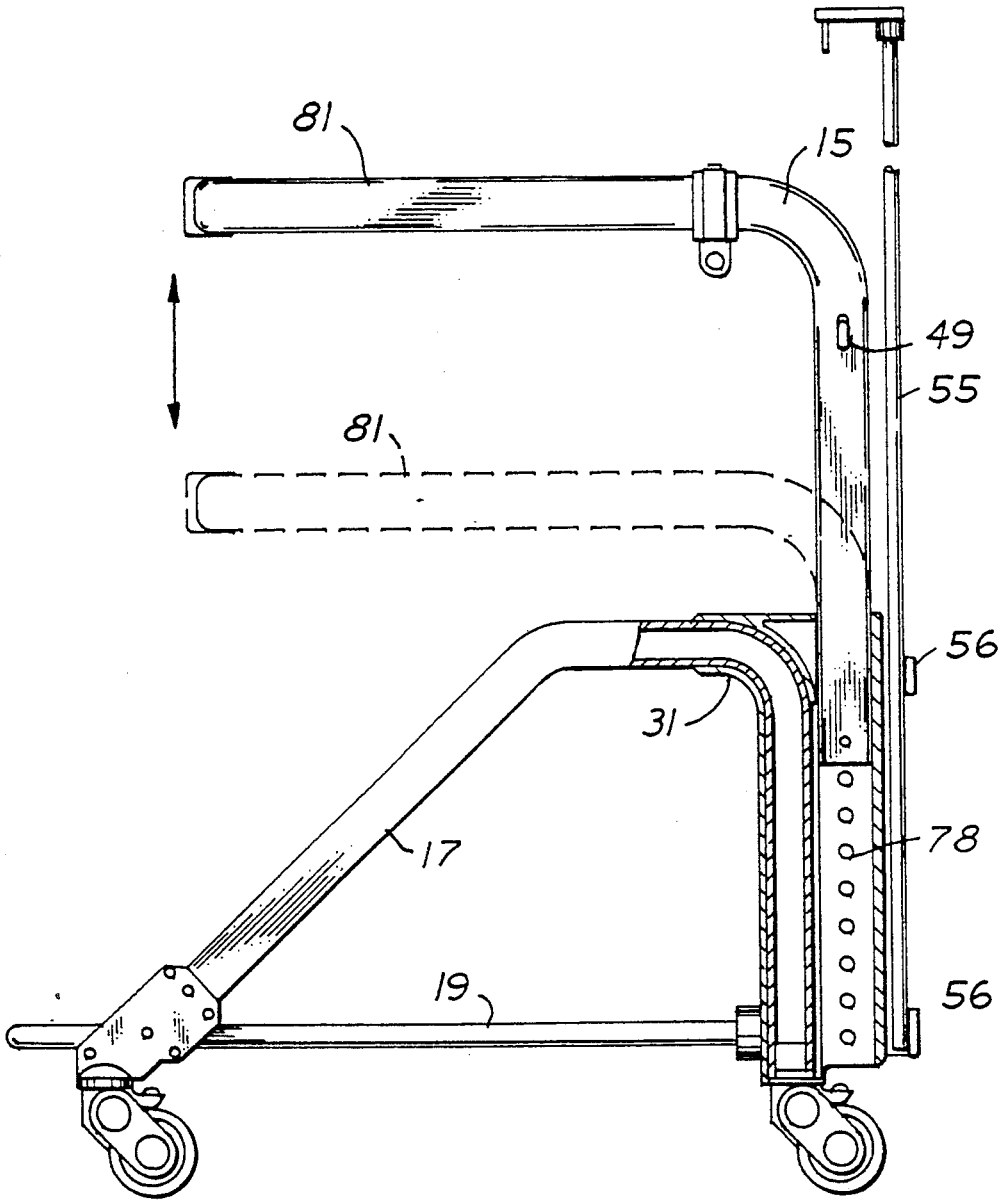
FIG. 2 shows a right side view, illustrating the method of adjusting the height of the device, and the provisions for attaching an intravenous feeding bag.

FIG. 2 shows a right side view, and demonstrates the manner in which the upper support frame 15 moves in the right height adjustment housing 31, which also forms structural support for the right structural reinforcing bar 17. An intravenous bag support pole 55 inserts into IV bag support pole brackets 56, which are "C"-shaped clamping receptacles molded into the right height adjustment housing 31.

Mounted on the lower end of the right and left height adjustment housings 31 and 33 are pressure braking casters 39, four of which are provided in this configuration, the preferred embodiment of the invention.

Figure 9:
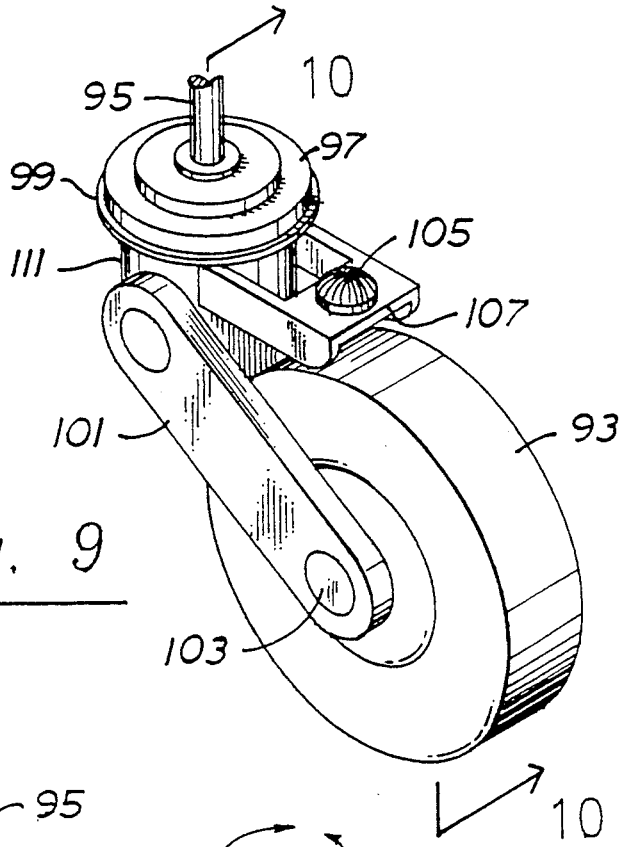
FIG. 9 is a perspective view of a pressure breaking swivel caster.
Figure 10:
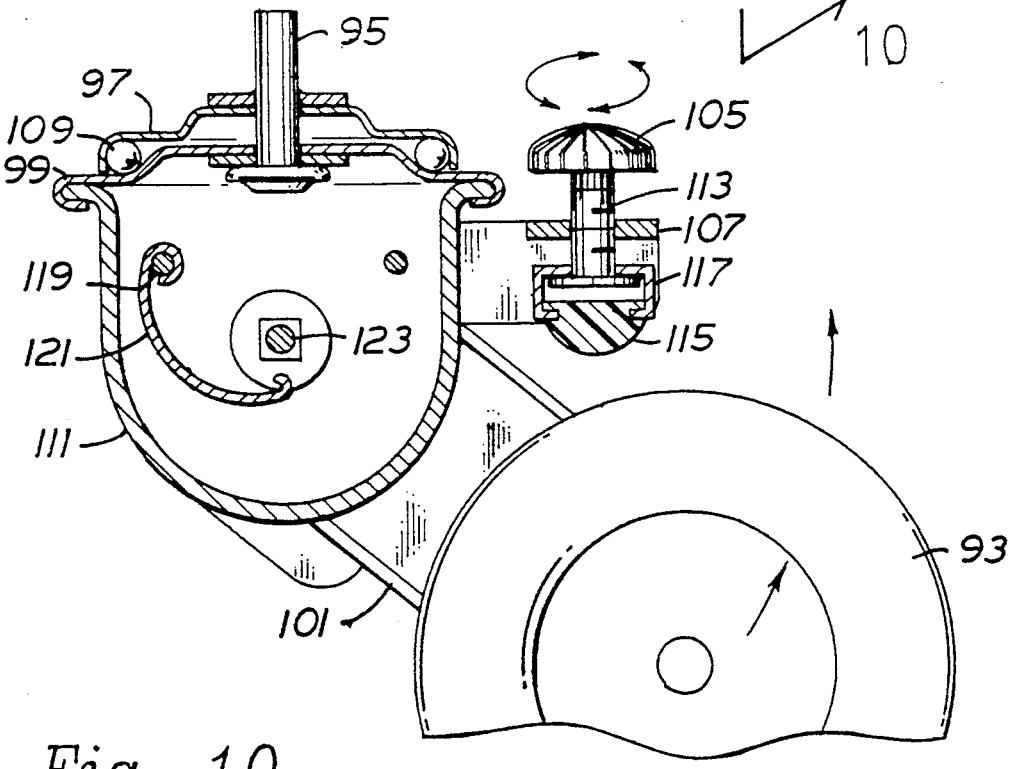
FIG. 10 is a sectional view of the pressure braking swivel caster.

FIGS. 9 and 10 show a perspective view and a sectional view of a representative pressure braking caster 39. Inside a spring assembly housing 111, a pivot axle 123 attaches to a wheel support 101. A spring 121 connects a fixed brake support bracket fastener 119 to the pivot axle. Downward pressure on the frame extends the spring 121, forcing a wheel 93, mounted on the opposite end of the wheel support, into contact with a brake pad 115, thus stopping the rotation wheel 93. The brake pad 115 adjusts via a brake adjustment knob 105 attached to a brake adjustment screw 113, increasing or decreasing the weight required to initiate the braking action. The spring assembly housing 111, attaches in turn to a lower support plate 99, connected through a thrust bearing 109 to an upper support plate 97, and fixed with a caster fastener 95.

Extending forward from the height adjustment housings 31 and 33, and connected to it at left and right rear pivot points 53 and 54 respectively, are right and left lower support members, 19 and 25 respectively, which form the lower forward portion of the frame. Right and left lower support members 19 and 25 connect at a lower width adjustment assembly 37 to form a U-shaped unit.

Right and left structural reinforcing bars 17 and 23 supply rigidity to the frame by connecting the upper portion of the height adjustment housings 31 and 33, and the forward side portions of the right and left lower support members 19 and 25 by right and left pivot bracket assemblies, 51 and 52 respectively. These bracket assemblies 51 also form the front mounts for the pressure braking casters 39, and a forward pivot point for the right lower support assemblies 83, (formed by the right structural reinforcing bar 17, and the right lower support member 19, with pressure braking casters 39, and right height adjustment housing 31) and left lower support assemblies 83, (formed by the left structural reinforcing bar 23, and the left lower support member 25, with pressure braking casters 39, and left height adjustment housing 33).

Figure 7A:
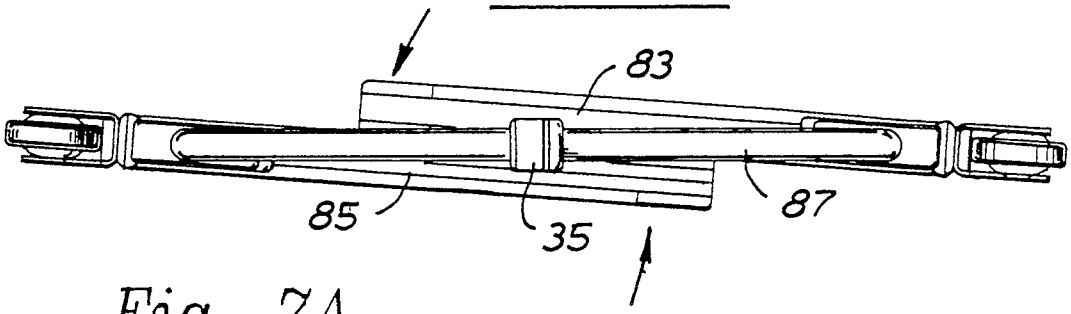
FIG. 7A is a top plan view showing the manner in which the device can be folded for storage.

FIG. 7A shows the manner in which the entire device can be folded for storage. The upper support assembly 81 (shown detached in FIG. 7) completely detaches from the rest of the frame. When the upper support assembly 81 is detached, the right and left lower support assemblies 83 and 85, which remain connected by a base assembly 87, fold inward to form a narrow profile, as depicted in FIG. 7A.

Figure 8:
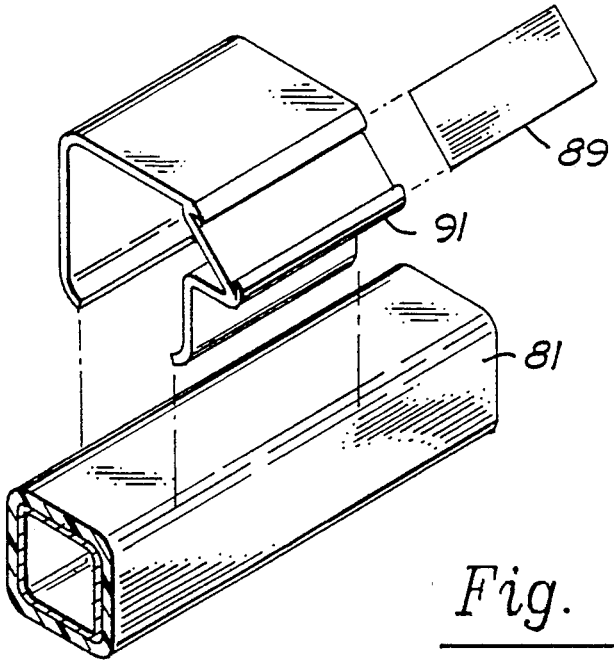
FIG. 8 is an exploded, perspective view of an identification tag assembly.

Identification can be attached to this preferred embodiment of the invention by a snap-on plate 91 (FIG. 8), which has a grooved recess to accept a label 89. Together, these attach to any portion of the upper support assembly 81.

Figure 11:
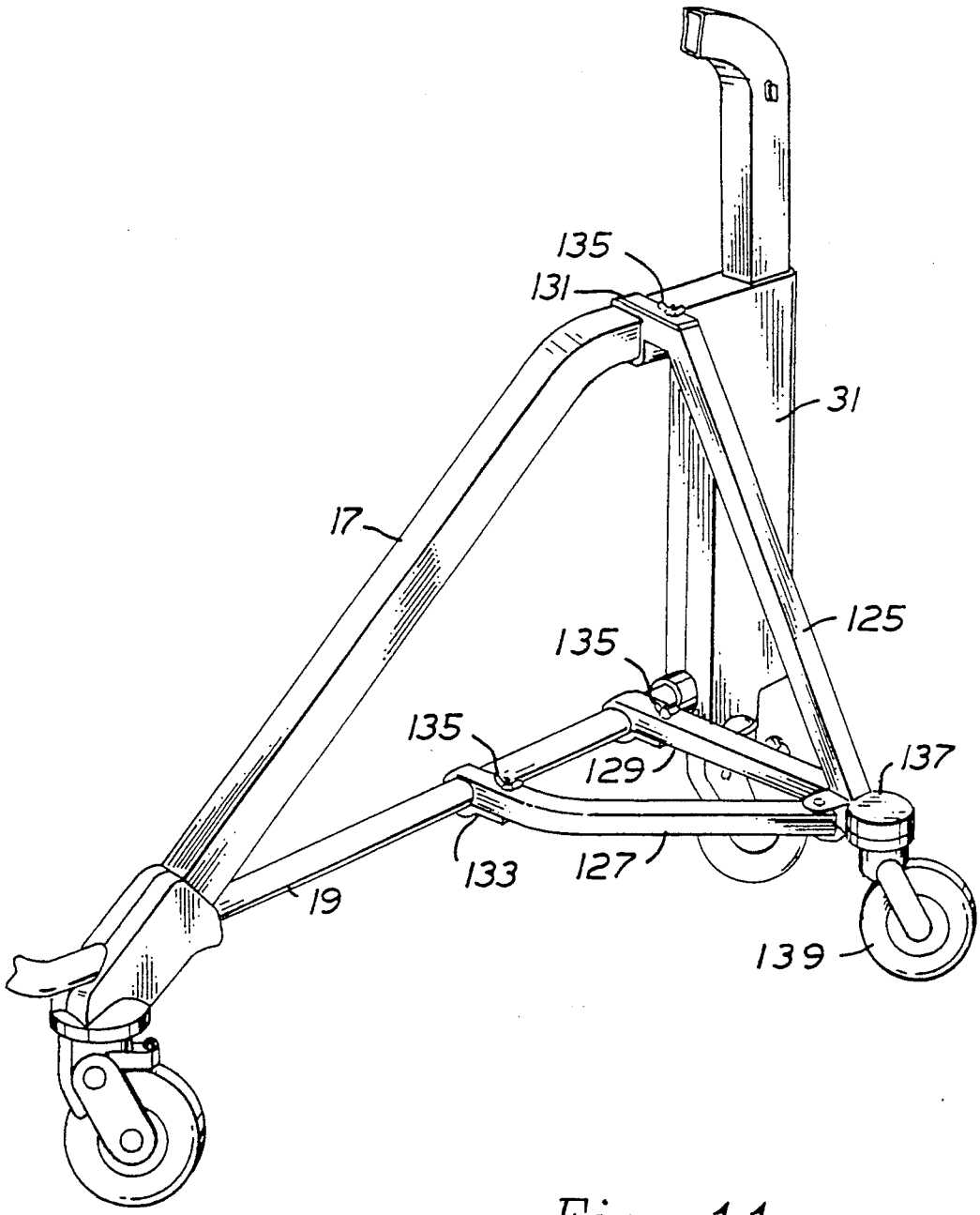
FIG. 11 is a perspective view of a detachable wide support stay.

FIG. 11 depicts a wide support stay that attaches to the perambulating therapeutic device to provide extra vertical stability. Two horizontal members, a front horizontal support member 127 and a rear horizontal support member 129, fasten to either the right or left lower support members 19 and 25 with a horizontal support clamp 133 which grips with a wing nut 135. An inclined support member 125 fastens to either the right or left structural reinforcing bars 17 or 23, respectively, in a similar manner, shown as a vertical support clamp 131, and wing nut 135. These three members join at a caster assembly cover 137, on which is fastened a standard swivel caster 139.

A strong feature of the perambulating therapeutic support is the ease by which a person can use it. First, the "U"-shaped upper support assembly 81 is adjusted to the proper height using the height adjustment push button 49. He or she then fastens the harness assembly 43 around the waist and beneath the crotch, and the device is backed up to a bed or chair. Bracing him or herself with the upper support assembly 81, the person elevates into a standing position. He or she then inserts the rear stay bar (comprising the left and right rear stay bars 27 and 29 connected with an upper width adjustment assembly 35) into position provided for the rear bar support brackets 47. The device will be held stable by the pressure braking casters 39.

The harness support brackets 45 connect and secure the harness assembly 43 to the upper support assembly 81. To ambulate, the occupant slightly lifts the entire assembly using both arms and legs, and moves forward. In case of a stumble, or a fall, the pressure breaking casters 39 will stop all motion, until the occupant has recovered sufficiently to continue the exercise. Thus, the device encourages use of the lower body, but requires a modicum of body strength to propel it. This mode of operation is significantly different from a walker, and unavailable with any of the prior art devices.

Where an unsteady patient is in danger of destabilizing the unit sideways, the wide support stays, illustrated in FIG. 11, provide extra stability.

While the preferred embodiment of the invention includes support via the harness assembly 43, people with less severe disabilities will still find it useful. Standing in the perambulating therapeutic support, they can grasp the upper support assembly 81, allow it to release the brakes, and push it forward. Stopping the horizontal motion with slight pressure, they then ambulate forward, and repeat the process.

In therapeutic ambulating programs, assistants propel, lift and guide the patient by means of a gait belt strapped around the waist. This procedure is difficult, sometimes requiring two assistants, and embarrassing to the patient. The perambulating therapeutic support can render obsolete this procedure, allowing safe and independent exercise, based on the individuals ability.

Although the description above contains many specificities, these should not be construed as limiting the scope of the invention, but as merely providing illustrations of some of the presently preferred embodiments of this invention, many more of which will occur to those skilled in the art.

Thus, the scope of the invention should be determined by the appended claims, and their legal equivalents, rather than by the examples given.

What is claimed is:

1. An apparatus having utility as a walking aid, comprising:

a "U"-shaped lower frame assembly including a transversely disposed forward part and a pair of parallel, longitudinally extending parts integral therewith that extend rearwardly therefrom to collectively form a three-sided area within which an individual using said apparatus may walk or stand;

a "U"-shaped upper frame assembly having substantially the same configuration as said lower frame assembly, said upper frame assembly being vertically spaced upwardly of said lower frame assembly, and said upper frame assembly lying in a plane parallel to a plane defined by said lower frame assembly;

a transversely disposed rear stay bar disposed in interconnecting relation to transversely opposed opposite ends of said upper frame assembly to enclose on four sides an individual using said apparatus;

an annular harness adapted to circumscribe an individual's waist, said harness being oriented in a plane parallel to the respective planes of said upper and lower frame assemblies;

said harness being positioned below the plane of said upper frame assembly and above the plane of said lower frame assembly;

a diametrically extending support strap interconnecting diametrically opposite parts of said harness;

a plurality of harness support straps extending radially from said harness to the transversely extending forward part of said upper frame assembly and said rear stay bar, said harness support straps having a preselected length to position said harness substantially centrally of said upper frame assembly;

said apparatus being rotatably supported by a plurality of caster wheels;

means for braking said caster wheels when downward pressure is applied thereto;

said upper frame assembly being vertically adjustable with respect to said lower frame assembly so that said apparatus accommodates individuals of differing heights;

height adjustment means for adjusting the height of said upper frame assembly with respect to said lower frame assembly;

width adjustment means operative to widen said apparatus to accommodate individuals of differing widths; and means for folding said apparatus.

2. The apparatus of claim 1, wherein said rear stay bar is detachably secured to said "U"-shaped upper frame assembly to facilitate entry of an individual into the space surrounded by said upper frame assembly.

3. The apparatus of claim 1, wherein said width adjustment means includes telescoping parts that collectively form said transversely disposed forward part of said upper frame assembly, said rear stay bar, and said transversely disposed forward part of said lower frame assembly, respectively, and wherein said width adjustment means further includes locking means for locking the telescoping parts into a preselected functional position of adjustment.

4. The apparatus of claim 3, wherein said means for braking said caster wheels includes a vertically adjustable brake pad positioned a preselected distance above a preselected caster wheel, a housing to which said brake pad is mounted, and a bias means disposed within said housing, said brake pad being positioned in vertically spaced relation to an associated caster wheel.

5. The apparatus of claim 4, wherein opposite ends of said bias means are secured to a pivot axle within said housing and a bracket fastener disposed within said housing in spaced relation to said pivot axle so that said bias means biases said housing and hence said brake pad away from said caster wheel.

6. The apparatus of claim 5, further comprising a support bracket for said brake pad, said support bracket extending radially from said housing, and said brake pad being screw threadedly engaged to said support bracket so that rotation of said brake pad adjusts the vertical spacing between said brake pad and its associated wheel so that the downward force required to engage said brake pad and associated wheel is adjustable.

7. The apparatus of claim 1, wherein said height adjustment means includes a left height adjustment housing, a right height adjustment housing, and a pair of extension members that are telescopically received within their associated height adjustment housings.

8. The apparatus of claim 7, further comprising locking means for locking said left and right height adjustment housings into a preselected functional position of adjustment relative to their associated extension members.

9. The apparatus of claim 8, wherein said height adjustment housings and their associated extension members are detachable from one another.

10. The apparatus of claim 9, further comprising:

an elongate lever disposed internally of each of said extension members;

each of said extension members being telescopically received within an inside support shroud, each of said inside support shrouds being housed within an associated height adjustment housing;

a plurality of apertures formed in said extension members and said inside support shrouds along the respective extents thereof;

a height adjustment locking pin secured to a distal end of said lever; and a height adjustment push button secured to a proximal end of said lever;

whereby the height of said apparatus is adjusted when said push button is pushed to retract said locking pin, and wherein a preselected height is locked in when said push button is released, said locking pin extending through said extension member holes and said inside support shroud apertures when said locking pin is extended.

11. The apparatus of claim 7, wherein opposite ends of said "U"shaped lower frame assembly are pivotally connected to respective lowermost ends of said height adjustment housings.

12. The apparatus of claim 11, further comprising an inclined structural reinforcing bar disposed in interconnecting relation between an upper end of each height adjustment housing and a forward end of said lower frame assembly.

13. The apparatus of claim 12, further comprising left and right pivot bracket assemblies positioned at the forward end of said "U"-shaped lower frame assembly so that said left and right height adjustment housings are foldable toward the central axis when said upper frame assembly is detached from said lower frame assembly.

14. The apparatus of claim 13, further comprising an upstanding feeding bag support pole that is secured to a preselected part of said apparatus.

15. The device of claim 1, further comprising means for enhancing the vertical stability of said device, said means including a wide support stay, said wide support stay including an auxiliary caster wheel positioned laterally of the caster wheels that support the device, said wide support stay including a triangular array of support members for connecting the auxiliary caster wheel to said device.

* * * * *